US006220156B1

(12) United States Patent
Rohloff

(10) Patent No.: US 6,220,156 B1
(45) Date of Patent: Apr. 24, 2001

(54) MULTI-COLOR CENTRAL IMPRESSION PRINTING DEVICE HAVING SELECTIVELY RAISED AND LOWERED PRINTING UNITS

(76) Inventor: Torald Rohloff, Hofellerstr, 45 a, D-97209, Veitshöchheim (DE)

( * ) Notice: Subject to any disclaimer, the term of this patent is extended or adjusted under 35 U.S.C. 154(b) by 0 days.

(21) Appl. No.: 09/530,957

(22) PCT Filed: Nov. 5, 1998

(86) PCT No.: PCT/DE98/03302

§ 371 Date: May 17, 2000

§ 102(e) Date: May 17, 2000

(87) PCT Pub. No.: WO99/25556

PCT Pub. Date: May 27, 1999

(30) Foreign Application Priority Data

Nov. 18, 1997 (DE) ..... 197 50 885

(51) Int. Cl.[7] ..... B41F 5/16; B41F 5/18; B41F 7/02

(52) U.S. Cl. ..... 101/175; 101/177; 101/183; 101/217

(58) Field of Search ..... 101/171, 174, 101/177, 181–185, 201, 212, 216–218, 245–248, 479, 480, 490, 492, 175

(56) References Cited

U.S. PATENT DOCUMENTS

| | | |
|---|---|---|
| 3,041,966 | 7/1962 | Polglase, Jr. . |
| 4,098,185 | 7/1978 | Davidson, Jr. . |
| 4,854,231 | 8/1989 | Jahn . |
| 4,936,211 | 6/1990 | Pensavecchia et al. . |
| 5,469,787 | 11/1995 | Turner et al. . |

FOREIGN PATENT DOCUMENTS

19503619 A1 2/1995 (DE) .

*Primary Examiner*—Kimberly Asher
(74) *Attorney, Agent, or Firm*—Jones, Tullar & Cooper, PC

(57) ABSTRACT

A plurality of individual printing groups are arranged about the periphery of a counter-pressure cylinder in a multi-color printing unit. The plurality of printing groups can selectively be combined into dual printing groups. These printing groups can be spaced at an acute angle. Alternatively, the printing groups can extend in a vertical direction and are arranged closely or at a short distance from each other. Selected ones of these printing groups can be raised and lowered.

7 Claims, 3 Drawing Sheets

MULTI-COLOR CENTRAL IMPRESSION PRINTING DEVICE HAVING SELECTIVELY RAISED AND LOWERED PRINTING UNITS

FIELD OF THE INVENTION

The present invention relates to a multicolor printing unit for a sheet-fed rotary printing press. The press has an access or servicing side and a drive side. A single counter-pressure cylinder, that carries a plurality of gripper systems, cooperates with at least four printing groves.

DESCRIPTION OF THE PRIOR ART

Printing devices, generally as described above have become known, for example from U.S. Pat. No. 4,098,185. Several printing cylinders, with their ink units have been arranged in a semicircular shape around a rubber blanket cylinder. The rubber blanket cylinder has a diameter which is several times the diameter of the printing cylinder. A counter-pressure cylinder, with a controllable row of grippers, acts together with the rubber blanket cylinder. The counter-pressure cylinder has a single diameter, i.e. the same diameter as the printing cylinders.

U.S. Pat. No. 3,041,966 discloses a multicolor printing unit for a web-fed rotary printing press, having a central counter-pressure cylinder and five printing groups. The printing groups with ink feeds, ink application rollers, printing cylinders and rubber blanket cylinders are not accessible from a service space which is easily accessible from the direction of a press side, i.e. from either the service or drive side of the press. Instead, it is required to first move all of the ink units away together in order to access a service space for the printing cylinder, rubber blanket cylinder and ink unit cylinders.

A service space for the four inking groups of a multicolor printing unit in accordance with DE 195 03 619 A1 is not accessible from the direction of a press side, i.e. from either the service or drive side of the printing press. Instead the service space, is only accessible from the feeding side, the delivery side, or from above.

SUMMARY OF THE INVENTION

The object of the present invention is based on providing a multicolor printing unit for printing sheet-like print carriers made of paper, for example.

This object is attained by means of the provision of a multi-color printing unit having a servicing side and a drive side. A single counter-pressure cylinder carries a plurality of sheet gripper systems and cooperates with at least four printing groups. A number of these printing groups are combined into dual printing groups having free access. Directly adjacent dual printing groups are arranged at an acute angle whose vertex points toward the counter-pressure cylinder.

The advantages which can be achieved with the multicolor sheet-fed rotary printing unit in accordance with the present invention will be briefly described in what follows. It is possible to manufacture a multicolor sheet-fed rotary printing press of the most compact construction. Nevertheless, good accessibility to the ink duct, screen roller, ink application roller, printing cylinder and rubber blanket cylinder is assured. Even with sheet-fed rotary printing presses for small formats, for example DIN A4, sufficient space remains for easily servicing the press and to arrange image devices for the print forme such as plate or foil or the print cylinder itself. Four-color printing of the sheets takes place in a single gripper operation. A perfect color registration becomes possible by means of this. No continuous raising and re-application of ink application rollers is required during the printing process. So-called slit fastenings, clamped fastenings, as well as sleeves, can be used for fastening the covers of the ink application rollers, the print formes and the rubber blankets. The use of sleeves is also possible in connection with screen rollers. In an advantageous manner, no dampening unit is provided. It is therefore possible to employ ink for "waterless" offset printing, UV inks, and also inks, wherein the dampening fluid, or a substitute for the dampening fluid which is worked into the ink itself or is chemically bonded with it, are already contained in the ink prior to filling the ink duct with it. It is also possible to use inks, wherein the dampening fluid or its substitute are supplied to the ink in the ink duct. So-called "hot melt" ink can also be employed.

The dual printing groups can be combined in a simple way from two individual printing groups.

BRIEF DESCRIPTION OF THE DRAWINGS

Preferred embodiments of the printing device of the present invention are represented in the drawings and will be described in greater detail in what follows.

Shown are in.

DESCRIPTION OF THE PREFERRED EMBODIMENTS

Figure 1:
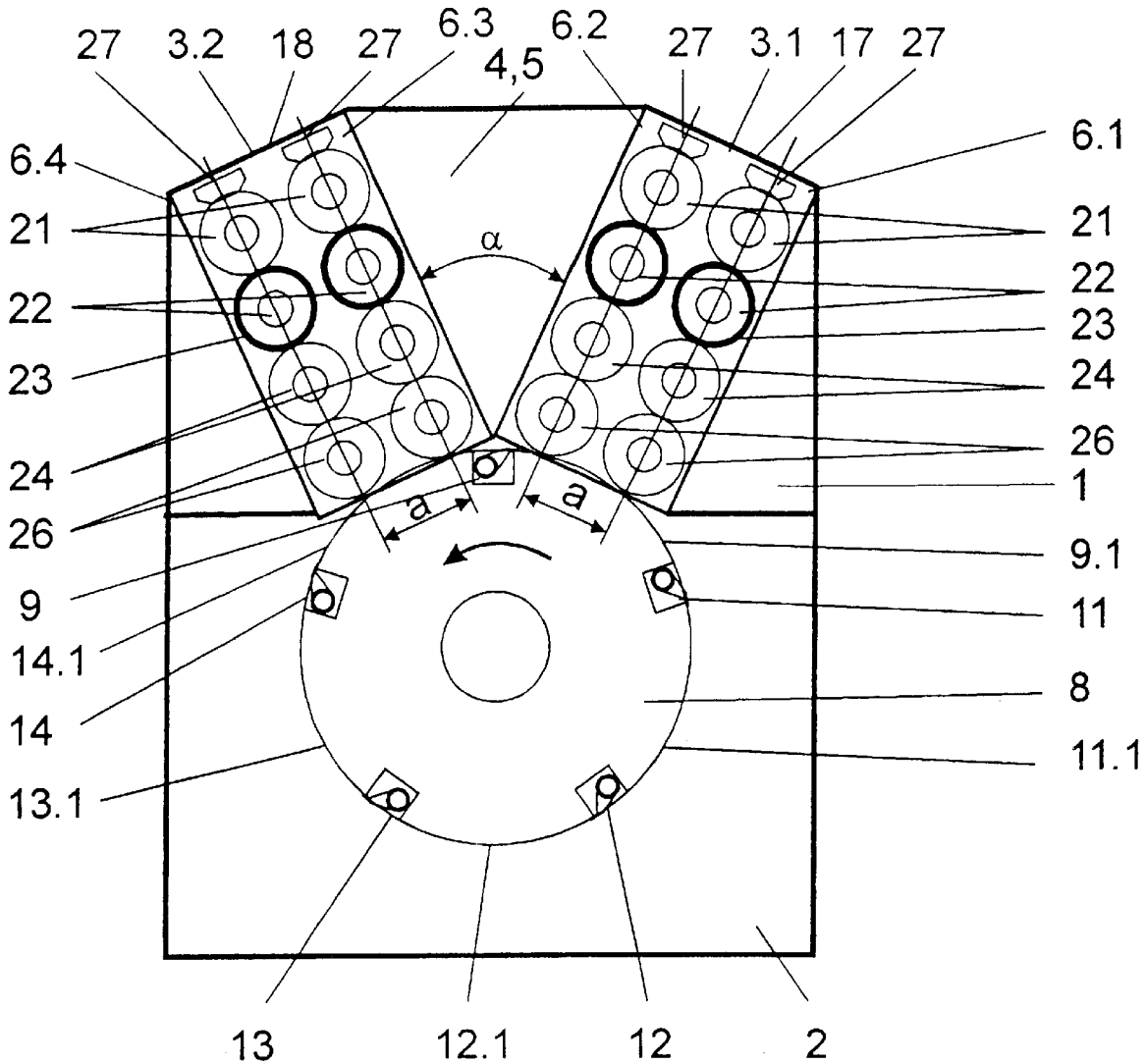
FIG. 1, a schematic side elevation view, on the service side, of a first preferred embodiment of the printing unit of the present invention, and consisting of a plurality of dual printing groups, cooperating with a single multi-sectional counter-pressure cylinder, and with the front frame removed for ease of illustration.

The printing unit 1 of the present invention, as shown in FIG. 1, essentially consists of: a lower frame 2, a plurality of, for example four printing groups 6.1, 6.2, 6.3, 6.4, and a multi-sectional counter-pressure cylinder 8 with a plurality, for example five, controlled rows of grippers 9, 11, 12, 13, 14 with their associated gripper supports. The surface of the counter-pressure cylinder 8 can have an oleophobic covering.

The sides of the press which are the most important for servicing the printing units are: the first front or end face, which faces a sheet feeder, the second front or end face located opposite the first front or end face, which faces a sheet delivery device, and an upper side, which permits access to the printing unit from above. Finally, there is provided a front side 4 of the press, which is, generally called the "service side". The rear side of the press, generally called the "drive side", because as a rule the drive motors are fastened on it, is located opposite this from or service side of the press.

Sheet-shaped print carriers, for example made of paper, are supplied to the printing unit 1 by a sheet feeder (not represented) and, after having been printed in several colors, are conducted to a sheet delivery device (not represented). In an advantageous manner, the printing unit 1 is freely accessible without interference through lateral frames at least from one side via a service space 5, i.e. from the direction of the "service side" and/or the "drive side". The "service side" extends between the insides of the lateral frames from the "service side" to the "drive side". At least the lateral frame of the "service side" is recessed in such a way that free access to the service space 5 is assured.

Figure 3:
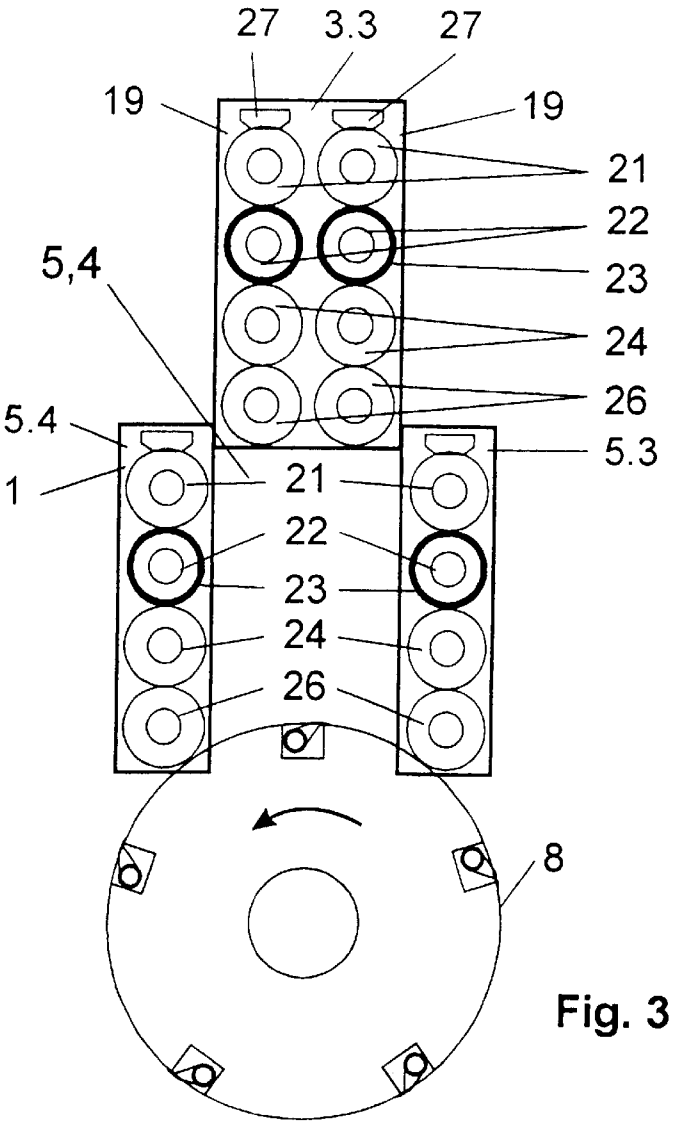
FIG. 3, the printing unit of FIG. 2, but with the dual printing group moved out.
Figure 2:
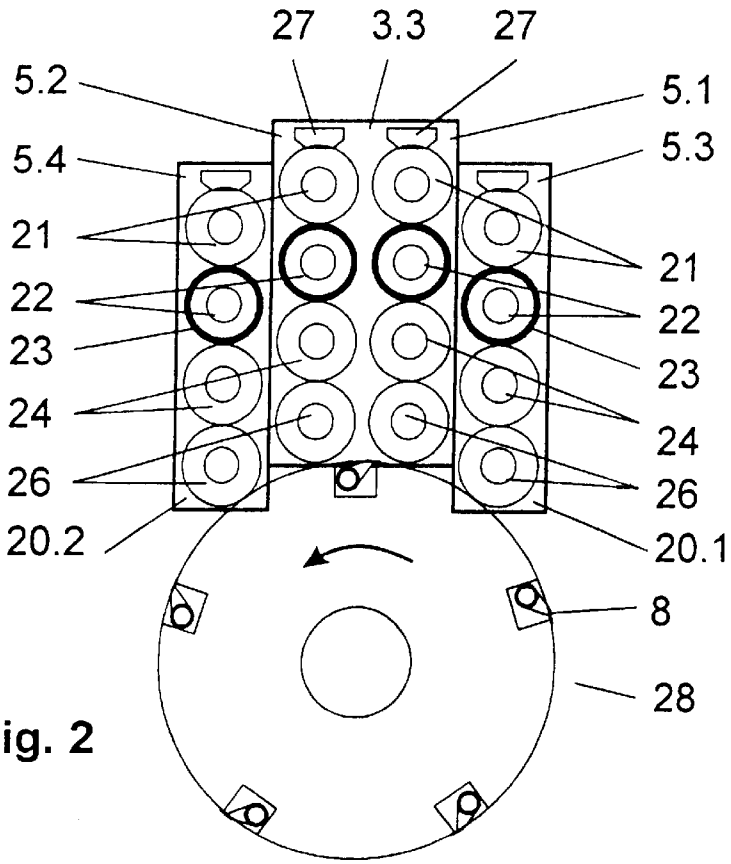
FIG. 2, a schematic side elevation view on the service side of a second preferred embodiment of the printing unit of the present invention with a dual printing group moved in, and without the front frame.

The service space 5 is constituted by the V-shaped arrangement of the first and second dual printing groups 3.1, 3.2 respectively, as seen in FIG. 1, or by the space between the first and second individual printing groups 5.3, 5.4 respectively, as shown in FIGS. 2–5, as soon as the center dual printing group 3.3 has been raised, as seen in FIG. 3. The single printing groups 5.1, 5.2, 6.1, 6.2, 6.3, 6.4 have been combined in pairs into dual printing groups 3.1 (=6.1+6.2), 3.2 (=6.3+6.4) (FIG. 1), 3.3 (=5.1+5.2), or are embodied as individual printing groups 5.3 and 5.4. The first dual printing group 3.1 has two lateral frames 17; the second dual printing group 3.2 has two lateral frames 18, the center dual printing group 3.3 has two lateral frames 19, the individual printing group 5.3 has two lateral frames 20.1, and the individual printing group 5.4 has two lateral frames 20.2. Arrangements for two independent ink flows are provided in each of the dual printing groups 3.1, 3.2, 3.3. Arrangements for one ink flow are provided in each of the individual printing units 5.3 and 5.4.

The dual printing groups 3.1, 3.2, 3.3 and the individual printing groups 5.3 and 5.4 are preferably equipped with so-called short ink units, as shown by way of example in FIG. 1.

The following constituent members have been rotatably seated for each of the ink flows in the lateral frames 17, 18, 19 of each of the dual printing groups 3.1 to 3.3 and in the lateral frames 20.1 and 20.2 of the individual printing groups 5.3 and 5.4: an ink metering roller 21, an ink application roller 22 with a rubber-elastic jacket 23, a printing cylinder 24 and a rubber blanket cylinder 26. All of these constituent members have the same effective circumference, or respectively diameter. Preferably they are all designed as so-called single circumference cylinders, or respectively rollers. However, the printing cylinder 24 and the rubber blanket cylinder 26 could also be embodied as so-called dual circumference cylinders. One ink supply device 27 per ink flow is provided between the lateral frames 17, 18, 19, 20.1, 20.2 and is fastened on them on the inside. The ink flow takes place from the ink supply device 27 via the ink metering roller 21, and the ink application roller 22 onto the printing forme of the printing cylinder 24. The printing forme of the printing cylinder 24 transfers its ink pattern to a rubber blanket of the rubber blanket cylinder 26. Together with a respective surface, for example the five sections 9.1, 11.1, 12.1, 13.1, 14.1 of the counter-pressure cylinder 8, the rubber blanket cylinders 26 each constitute a print location for the sheet-shaped print carriers, for example made of paper, to be printed.

Each ink supply device 27 can be of the most diverse construction. For example, it can be a conventional ink duct with ink blade(s). However, chamber doctor blades of the most diverse construction can also be provided. For example, these can be a negatively set working doctor blade and a positively set fining doctor blade, or also with negatively set working and finishing doctor blades.

The structure of the jacket of the ink metering rollers 21 is adapted to the properties of the materials of the ink blades, or respectively of the doctor blade. The jacket is oleophilic and can be made of metal, plastic, a ceramic material or the like. The surface of the jacket can be smooth or structured or can, for example, have small cups, or so-called cross-hatchings, or combinations of the two.

The printing cylinders 24 have fastening devices, known per se, for flat-bed printing plates, either wet offset, or dry offset, or flat-bed sleeves, which are placed on them. The printing cylinders 24 can also be interchangeably removable. They are seated in rotatable eccentric sleeves, known per se, in the lateral frames 17, 18, 19, 20.1, 20.2 for being placed against or away from the cylinder for printing.

The rubber blanket cylinders 26 are equipped with fastening devices, known per se, for rubber blankets or rubber blanket sleeves.

A driven multi-sectional counter-pressure cylinder or gripper drum 8 is seated in the lower frame 2. It is embodied as a so-called multiple circumference drum. Its effective circumference, or respectively diameter, is a multiple of the effective circumference, or respectively diameter, of a single circumference printing cylinder 24, or respectively, rubber blanket cylinder 26.

The number of sections 9.1, 11.1, 12.1, 13.1, 14.1 of the counter-pressure cylinder 8 corresponds to the number of the controlled gripper rows 9, 11, 12, 13, 14. They each adjoin them directly and constitute the counter-pressure surfaces for the rubber blanket cylinders 26.

The printing units 1 and 28 for multicolor printing and preferably for four-color printing, consist of a plurality, for example three, printing groups 3.1 to 3.3, and of a single counter-pressure cylinder 8 assigned to them. The effective diameter of the counter-pressure cylinder 8 of such a multicolor printing unit 1, or respectively 28, of the invention in this case is at least equal to or is greater than the product from the multiplicant: "effective diameter of the printing cylinder 24 or the rubber blanket cylinder 26" and the multiplier: "number of the printing groups (6.1 to 6.4, or respectively 5.1 to 5.4) of the printing unit 1 (FIG. 1), or respectively of the printing unit 28 (FIG. 2) minus one". The number of the sections 9.1 to 14.1 on the circumference of the counter-pressure cylinder 8 is selected correspondingly. Thus, with a four-color printing unit 28 at least three of the sections 9.1 to 14.1 are provided. The jacket surface of the counter-pressure cylinder 8 could also have four, five, six, etc. sections.

Conventional grippers, which are not specifically represented, can be used in the gripper rows 9 to 14. The use of grippers, known per se, which are designed in such a way that, following their closing, they come to lie completely inside the circular periphery of the counter-pressure cylinder 8, would be particularly advantageous.

As already described above and as represented in FIGS. 1 to 3, the printing groups 6.1 to 6.4, 5.1 to 5.4, each with an ink supply device 27, an ink metering roller 21, an ink application roller 22, a printing cylinder 24 and a rubber blanket cylinder 26, can be designed as dual printing groups 3.1 to 3.3, or as individual printing groups 5.3 to 5.4 (FIGS. 2 and 3), and can be fastened on the lower frame 2.

Respectively two individual printing groups, for example 5.1 with 5.2, or 6.1 with 6.2, are combined into dual printing groups 3.1 to 3.3 in such a way that they each constitute a functional unit. This means that in the assembled state they constitute a unit.

As represented in FIG. 1, several dual printing groups 3.1, 3.2—preferably two, but also three—can be assigned to a counter-pressure cylinder 8.

In an arrangement of two dual printing groups 3.1, 3.2 around a counter-pressure cylinder 8, these two dual printing groups are arranged in a V-shape—at an angle —in respect to each other. With more than two, they are arranged radially.

As represented in FIGS. 2 to 5, dual printing group 3.3 and individual printing groups 5.3 and 5.4 of a mixed arrangement can be assigned to a counter-pressure cylinder 8. For example, one dual printing group 3.3 and several, for example two, individual printing groups 5.3, 5.4 can be assigned to the counter-pressure cylinder.

In a mixed arrangement, preferably one individual printing group 5.3 and 5.4 is arranged to the left and right of the central dual printing group 3.3 in a height-displaceable manner and fixable in place. The center dual printing group 3.3 and the individual printing groups 5.3 and 5.4 are preferably arranged close together so that their lateral frames have no spacing distance from each other. For this purpose, the left and right lateral sides of the lateral frames 19 of the central dual printing group 3.3 and the inner lateral sides of the lateral frames 20.1 and 20.2 of the individual printing groups 5.3 and 5.4 can be interlockingly connected, for example by means of a dovetailed guide.

It is possible for the individual printing groups 5.3 and 5.4 to be fixed in place, i.e. to be rigidly connected with the lower frame 2. In this case, the center dual printing group 3.3 must be movable up and down for changing printing plates or rubber blankets and must be able to be raised high enough and fixed in place in such a position that access to the two printing cylinders 24 and/or the two rubber blanket cylinders 26 is easily and without danger made possible.

It is also possible for the dual printing group 3.3 to be fixed in place, i.e. to be permanently fixedly connected with the lower frame 2. Then the individual printing groups 5.3, 5.4 must be movable up and down and fixable in place for changing the printing plates and/or rubber blankets of the dual printing group 3.3. One toothed rack is fastened in the guides of the printing group 3.3, or respectively 5.3 and 5.4, to be moved for moving the dual printing group 3.3 and the individual printing groups 5.3 and 5.4 up and down. The teeth of the toothed rack are in engagement with a pinion of a self-locking gear. The gear is driven, for example, by an electric motor. The gear is supported on the respectively non-movable printing group(s). If it is desired to move the dual printing group 3.3 up and down, the gears are supported on the lateral frames 20.1, or respectively 20.2 of the individual printing groups 5.3, or respectively 5.4. If, however, it is desired to move the individual printing groups 5.3, 5.4 up and down, the gears are supported on the lateral frames 19 of the dual printing group 3.3.

To prevent the unintended lowering of the printing groups 3.3, 5.3, 5.4, it is possible to provide a lowering safety, for example so-called catches.

Drive mechanisms other than gears can also be provided for moving the printing groups up and down, for example hydraulic lifting devices can be used for this purpose.

Following the lowering of the printing groups 3.3, or respectively 5.3 and 5.4 from a service position into their operating position, the movable printing groups 3.3, or respectively 5.3 and 5.4 are fixedly locked together with the printing groups 5.3 and 5.4, or respectively 3.3, fixed in place on the lower frame, and are also additionally locked together with the lower frame 2, in order to obtain stable mechanical conditions and therefore a good print quality. This can be done, for example, by means of a motor-driven screwing together of the movable lateral frames to the fixed ones.

Figure 5:
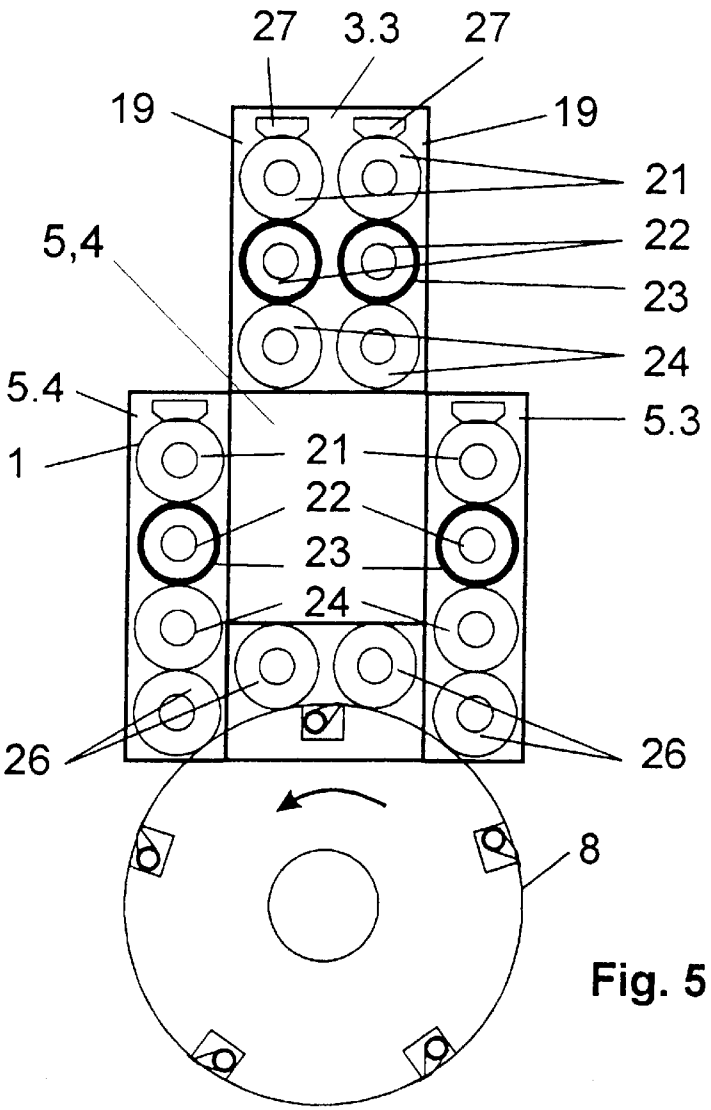
Figure 4:
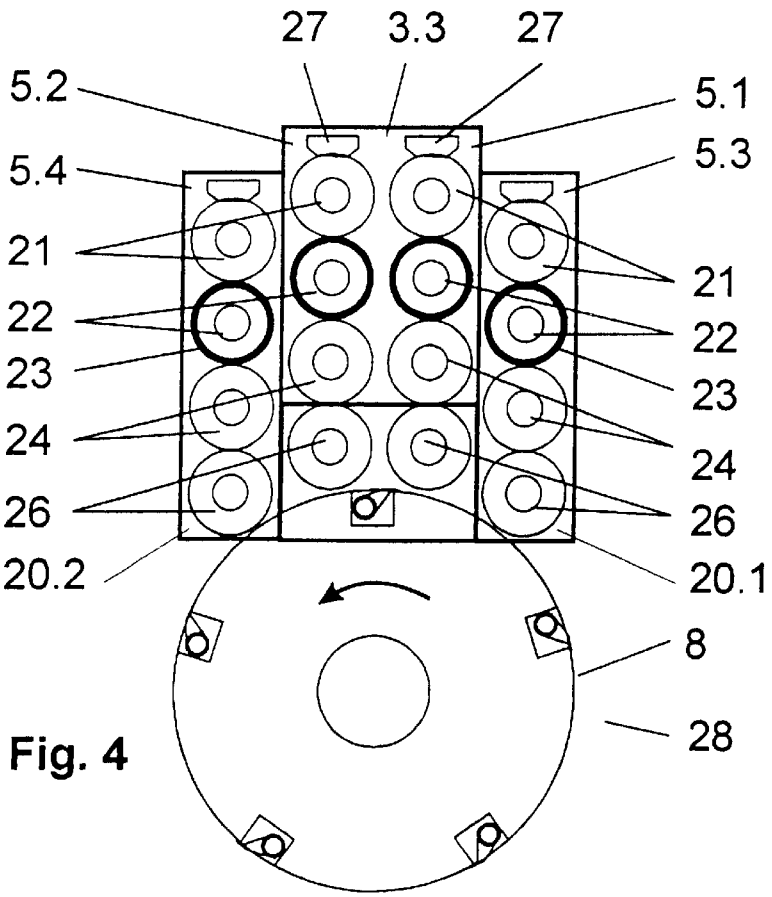
FIG. 4, a schematic side elevation view on the service side of a third preferred embodiment of the printing unit of the present invention with the dual printing group moved in, and in which the rubber blanket cylinders are fixed in place, i.e. cannot be raised or lowered, and without the front frame; and in FIG. 5, the printing unit of FIG. 4, but with the dual printing group moved out and rubber blanket cylinders fixed in place.

As represented in FIGS. 4 and 5, the center dual printing group 3.3 can also be horizontally divided. In this case, the two rubber blanket cylinders are seated in a frame, which is fixed in place. Thus, they cannot be moved up or down. Only the ink supply devices 27 and the other cylinders 21, 22, 24 can be raised and lowered together.

The center dual printing group 3.3 and the individual printing groups 5.3, 5.4 can also be arranged spaced apart by a few centimeters.

The drive of the dual printing groups and of the individual printing groups can take place via a common toothed gear train from a common main drive mechanism of the printing press, or via rpm-controlled individual drive mechanisms such as a frequency-controlled rotary current motor.

Two printing arrangements 1 and/or 28 of the present invention can be expanded by the interposition of sheet transfer drum(s), known per se, with only controllable gripper rows, or of sheet transfer drum(s), known per se, with a sheet turning arrangement. The number of colors can be increased by this, and/or multicolor obverse and reverse printing can be possible.

While preferred embodiments of a printing device in accordance with the present invention have been set forth filly and completely hereinabove, it will be apparent to one of skill in the art that various changes in, for example the overall sizes of the cylinders, the types of paper being printed on and the like could be made without departing from the true spirit and scope of the present invention which is accordingly to be limited only by the following claims.

What is claimed is:

1. A multi-color printing unit for a sheet fed rotary printing press, the multi-color printing unit having a servicing side and a drive side and comprising:

a counter-pressure cylinder with a plurality of controlled sheet gripper systems, said counter-pressure cylinder having a first diameter;

at least four individual printing groups, each of said four individual printing groups including at least one ink supply device, one ink application roller, one printing cylinder and one rubber blanket cylinder having a second diameter, said first diameter of said counter pressure cylinder being a multiple of said second diameter; and means combining said at least four individual printing groups into at least first and second dual printing groups, said at least first and second dual printing groups each being spaced apart from each other by a servicing space, said servicing spacing being accessible from at least one of the servicing side and the drive side of said multi-color printing unit, each of said at least first and second dual printing groups being arranged adjacent to each other and at an acute angle, said acute angle having a vertex, said vertex pointing toward said counter-pressure cylinder.

2. A multi-color printing unit for a sheet-fed rotary printing press comprising:

a single counter-pressure cylinder with a plurality of controlled gripper systems, said counter-pressure cylinder having a first diameter; and at least two outer printing groups and at least two inner printing groups, each of said outer and inner printing groups having one ink supply device, one ink application roller, one printing cylinder and one rubber blanket cylinder having a second diameter, said first diameter being a multiple of said second diameter, said outer and inner printing groups being positioned adjacent to, and vertical with respect to said counter-pressure cylinder, and closely horizontally positioned with respect to each other when in an operating position, selected ones of said inner and outer groups being raisable and lowerable with respect to said counter-pressure cylinder.

3. The multi-color printing unit of claim 1 further wherein all of said inner and outer printing groups are raisable and lowerable.

4. The multi-color printing unit of claim 1 wherein said at least two outer printing groups are raisable and lowerable and said at least two inner printing groups are fixed.

5. The multi-color printing unit of claim 1 wherein said at least two inner printing groups are raisable and lowerable and said at least two outer printing groups are fixed.

6. The multi-color printing unit of claim 1 wherein said at least two inner printing groups are combined into at least one dual printing group.

7. The multi-color print unit of claim 1 wherein said at least two outer printing groups are fixed in place and wherein said rubber blanket cylinders of said at least two inner printing groups are fixed in place.

* * * * *

UNITED STATES PATENT AND TRADEMARK OFFICE

CERTIFICATE OF CORRECTION

PATENT NO. : 6,220,156 B1
DATED : April 24, 2001
INVENTOR(S) : Torald Rohloff

It is certified that error appears in the above-identified patent and that said Letters Patent is hereby corrected as shown below:

Column 8, claims 3, 4, 5, 6 and 7,
Line 1, after "claim" change "1" to -- 2 -- .

Signed and Sealed this

Twentieth Day of November, 2001

*Attest:*

Nicholas P. Godici

NICHOLAS P. GODICI
*Acting Director of the United States Patent and Trademark Office*

*Attesting Officer*